United States Patent [19]

Ueno et al.

[11] 4,380,384

[45] Apr. 19, 1983

[54] CHARGING DEVICE FOR ELECTRONIC COPIER

[75] Inventors: Tsuyoshi Ueno, Fujisawa; Hideo Mukai, Yokohama, both of Japan

[73] Assignee: Tokyo Shibaura Denki Kabushiki Kaisha, Kawasaki, Japan

[21] Appl. No.: 227,779

[22] Filed: Jan. 23, 1981

[30] Foreign Application Priority Data

| | | | |
|---|---|---|---|
| Jan. 25, 1980 | [JP] | Japan | 55-7511 |
| Jan. 25, 1980 | [JP] | Japan | 55-7512 |
| Jan. 25, 1980 | [JP] | Japan | 55-7513 |
| Jan. 25, 1980 | [JP] | Japan | 55-7824[U] |
| Jan. 25, 1980 | [JP] | Japan | 55-7825[U] |

[51] Int. Cl.[3] ..... G03G 15/02

[52] U.S. Cl. ..... 355/3 CH; 355/14 CH

[58] Field of Search ..... 355/3 CH, 3 TR, 14 CH, 355/14 TR; 430/902; 250/325

[56] References Cited

U.S. PATENT DOCUMENTS

| | | | |
|---|---|---|---|
| T875,026 | 6/1970 | Scharf | 355/3 CH X |
| 2,934,649 | 4/1960 | Walkup | 355/3 CH X |
| 3,626,260 | 12/1971 | Kimura et al. | 430/902 X |
| 3,684,364 | 8/1972 | Schmidlin | 355/3 CH |
| 3,691,993 | 9/1972 | Krause et al. | 355/3 TR X |
| 4,274,361 | 6/1981 | Sanders et al. | 355/3 TR X |

*Primary Examiner*—G. Z. Rubinson
*Assistant Examiner*—Keith E. George
*Attorney, Agent, or Firm*—Cushman, Darby & Cushman

[57] ABSTRACT

A charging device for an electronic copier including a charging belt having a characteristic resistance ranging from $10^4$ to $10^{10}$ Ω.cm. The copier's charging belt is in contact with the photosensitive drum, and as the photosensitive drum is rotated a voltage smoothly increasing over a predetermined period of time is applied to the charging belt for uniformly charging the photosensitive drum.

9 Claims, 11 Drawing Figures

CHARGING DEVICE FOR ELECTRONIC COPIER

BACKGROUND OF THE INVENTION

This invention relates to electronic copiers and, more particularly, to improvements in the charging device for electronic copiers.

In the electronic copier, a light-sensitive medium is precharged by a charging device prior to its exposure to a light image of an original as is well known in the art.

The prior art charging devices include corona chargers making use of the corona discharge and contact chargers having a conductive brush or a charging roller held in forced contact with the light-sensitive medium for charging the medium by contact charging. The corona charger is simple in construction and has steady performance. However, it uses a high voltage source of 5 to 10 kilovolts and, therefore, its safety and economy are inferior. Further, during the corona discharge it produces ozone and extremely deteriorates the properties of the light-sensitive medium, developer and other materials. The contact charger requires a low voltage source of 0.5 to 1 kilovolt. Also, since it is not based upon corona discharge, it is free from the generation of ozone. On the demerit side of this charger, however, it is difficult to obtain continuous uniform charging, and therefore the reliability is low. More particularly, with this charger the voltage required for the charging of the light-sensitive medium is applied in one step as a pulse voltage; that is, the maximum voltage is applied at the point of the commencement of contact between the light-sensitive medium and conductive brush or charging roller. Since in this case a sharp change of the applied voltage occurs at the commencement of contact, uniform charging of the light-sensitive medium cannot be obtained. In addition, the light-sensitive medium is likely to be electrically damaged.

SUMMARY OF THE INVENTION

The invention seeks to provide an economical and highly safe electronic copier, which comprises a charging means including a charging belt held in contact with a photosensitive medium and having a characteristic resistance and a power supply means for applying a voltage smoothly rising in a predetermined period of time to the charging belt to produce a potential gradient in the charging belt, thus providing a uniform charging performance.

To achieve the above objective, the electronic copier according to the invention comprises a photosensitive medium, a charging belt means provided in contact with the photosensitive medium and having a characteristic resistance ranging from about $10^4$ to about $10^{10}$ Ω.cm, a power supply means for applying a voltage smoothly rising in a predetermined period of time to the charging belt means, an exposure device for forming an electrostatic latent image of a light signal on the photosensitive medium, a developing device for developing the electrostatic latent image formed on the photosensitive medium, a transfer device for transferring the visible image formed on the photosensitive medium on a recording sheet, and a fixing device for fixing the visible image transferred onto the recording sheet.

The above and other objects and features of the present invention will be apparent from the following description taken in connection with the accompanying drawings, in which:

DETAILED DESCRIPTION OF THE PREFERRED EMBODIMENTS

Figure 1:
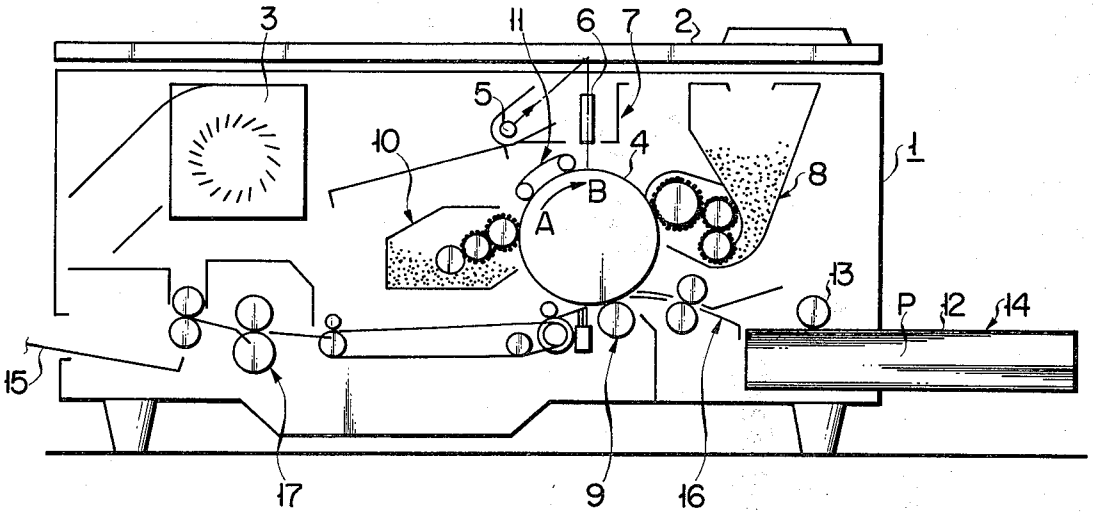
FIG. 1 is a schematic longitudinal sectional view showing an electronic copier embodying the invention.

FIG. 1 is a schematic longitudinal sectional view of an electronic copier embodying the invention. An original underlay 2 is provided on the top of a copier body 1. The original underlay 2 is adapted to be reciprocated from a drive motor 3 provided with the body 1. Substantially at the center of the body 1, a photosensitive medium 4 consisting of a resin dispersoid in lead oxide in the form of a drum is supported. An exposure system 7 including a lamp 5 and an optical fiber 6 is provided between the photosensitive drum 4 and original underlay 2. It is adapted to illuminate an original held on the original underlay 2, and light reflected by the original is led to the photosensitive drum 4 and focused thereon as a light image of the original. A developing device 8, a transfer device 9, a cleaning device 10 and a charging device 11 are provided on the mentioned order along the drum 4 in the direction of rotation thereof from the focusing position mentioned above. The developing device 8 serves to develop a latent image of the original that is formed on the surface of the drum 4 by the function of the exposure system 7, thus obtaining a visible image. The transfer device 9 transfers the toner image formed on the photosensitive medium 4 on the copying sheets P. The cleaning device 10 serves to remove residual toner from the surface of the drum 4.

The bottom of the body 1 is provided with a sheet supply unit 14 including a removably mounted sheet cassette 12 accommodating a plurality of copying sheets P and a sheet feed roller 13 for feeding out the copying sheets P one after another. Between the supply unit 14 and the transfer device 9 and between the supply unit 14 and a tray 15, a sheet feed path 16 consisting of rollers and guide members is provided continuously. Each copying sheet P supplied from the sheet supply unit 14 is fed along the sheet feed path 16 to pass between the photosensitive drum 4 and transfer device 9 for the transfer of the original image onto it before it is conveyed to the copy tray 15. A fixing unit 17 is provided to face the feed path 16 between the transfer device 9 and tray 15. It serves to fix the original image transferred onto the copying sheet P.

Figure 2:
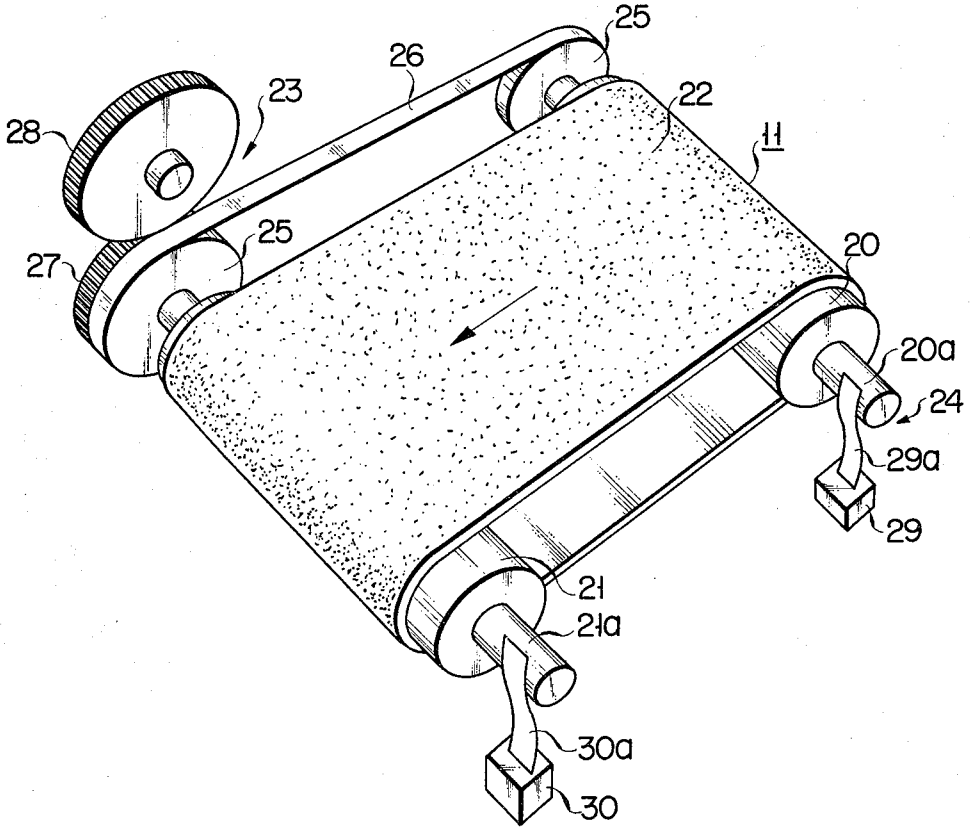
FIG. 2 is a perspective view of a charging device shown in FIG. 1.

The charging device 11 will now be described in detail. As is shown in FIG. 2, it includes a first roller 20, a second roller 21, an endless charging belt 22 passed round these rollers and a power supply means 24. The charging belt 22 is a conductive belt having a characteristic resistance of about $10^4$ to about $10^{10}$ Ω.cm. The rollers 20 and 21 are made of a conductive material, and their support shafts 20*a* and 21*a*, which are also made of a conductive material, projects from their opposite ends. The shafts 20*a* and 21*a* are supported in bearings (not shown), and they carry respective pulleys 25, 25 of an insulating material secured to their one end. These pulleys 25, 25 constitute a drive mechanism 23 with a drive belt 26 passed round them. A driven gear 27 is provided on the shaft 21*a* of the second roller 21 and is in mesh with a drive gear 28 provided in a drive source (not shown). With the rotation of the drive gear 28 the rollers 20 and 21 are rotated to drive the charging belt 22 in the direction of arrow (i.e., in the direction of rotation of the photosensitive drum 4).

Figure 3:
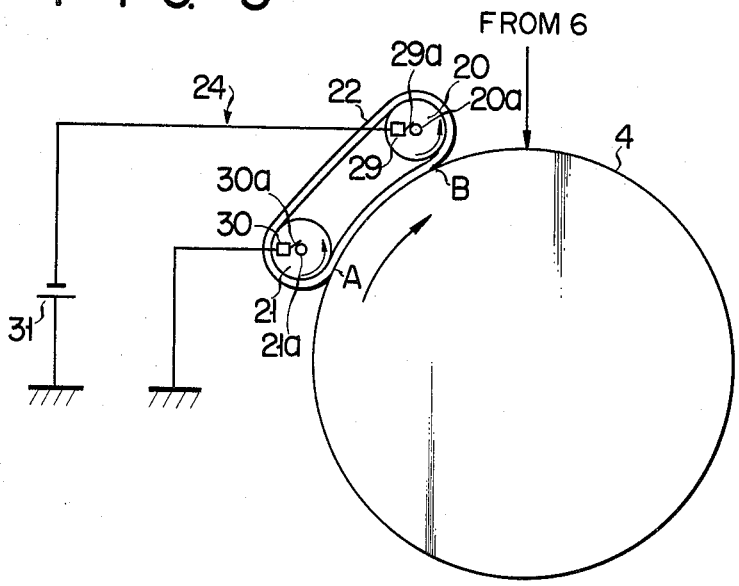
FIG. 3 is a schematic side view of the charging device shown in FIG. 2.
Figure 4:
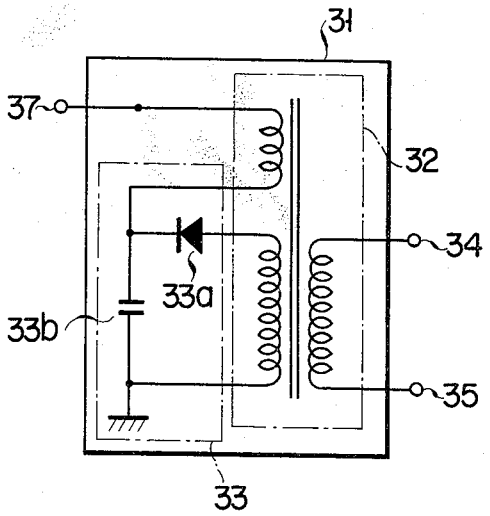
FIG. 4 is a circuit diagram showing a power supply circuit constituting a power supply means.

In contact with the other end of the shafts 20*a* and 21*a* are brushes 29*a* and 30*a* provided in terminals 29 and 30 constituting the power supply means 24 mentioned above. As shown in FIG. 3, the terminal 29 having the brush 29*a* is grounded through a power supply 31, while the terminal 30 having the brush 30*a* is directly grounded. FIG. 4 shows a power source unit 31 which supplies a voltage to the brush 29*a* mentioned above. It includes a ferro-resonance transformer 32 and a rectifying circuit 33. The rectifying circuit 33 has a diode 33*a* and a capacitor 33*b*. With an AC voltage supplied between input terminals 34 and 35, the transformer 32 provides an output voltage at an output terminal 37. The output voltage is supplied to the rectifying circuit 33 and a DC voltage output is coupled to the output terminal 37.

Figure 5:
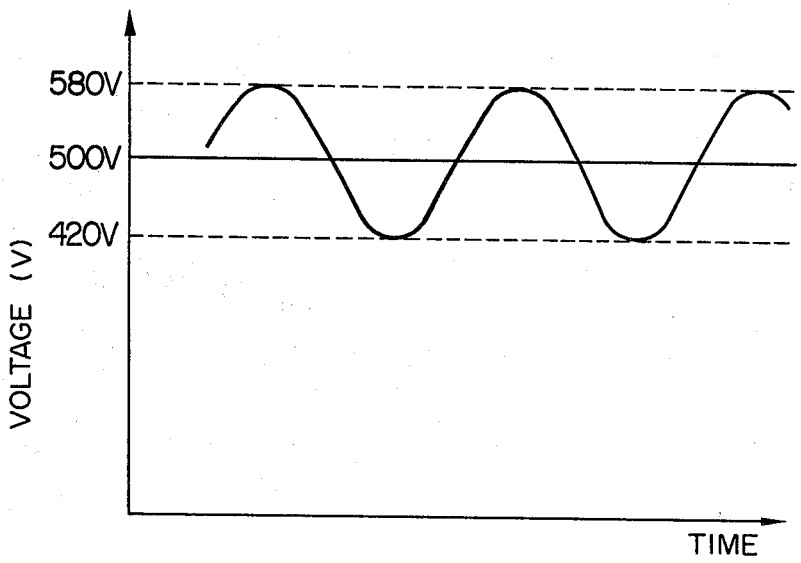
FIG. 5 is a view showing the waveform of the output of the power supply circuit.
Figure 6:
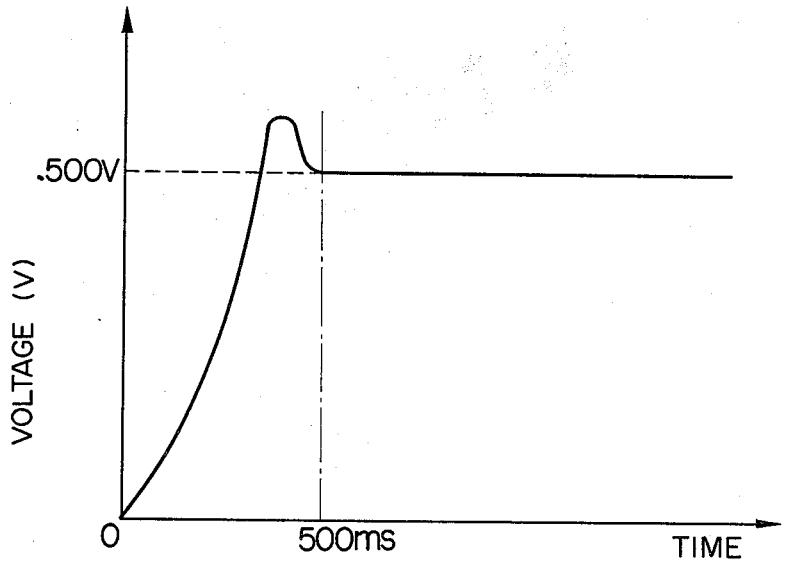
FIG. 6 is a view showing the waveform of the characteristic output of a ferro-resonance transformer used in the power supply circuit.

Through this electric connection, a voltage consisting of DC and AC voltages superimposed upon each other, as shown in FIG. 5, is applied through the brush 29*a* to the first roller 20. This voltage is obtained by superimposing a DC voltage and an AC voltage with a peak-to-peak value of less than about 20% of the DC voltage; in a specific example, a DC voltage of about 500 volts and an AC voltage of 80 volts are superimposed. As a result of experiments, it has been found that if the AC voltage component is above 100 volts (i.e., above 20% of the DC), fluctuations of charging in the direction at right angles to the direction of rotation of the photosensitive drum 4 is liable to appear in the form of fringes, while if it is below 50 volts the effect of recovering the fatigue due to repeated use cannot be obtained. The best range of the AC component to be incorporated, is thus between about 80 volts and about 100 volts. FIG. 6 shows a characteristic of the ferro-resonance transformer 32 mentioned above. As is shown, when the supply voltage is impressed, the output voltage is progressively increased to exceed a predetermined level once and settles to that level after the lapse of about 500 msec. In other words, a period of about 500 msec. is required for the rising of the output, and it is likely that during this period a steady voltage cannot be provided to a corresponding portion of the photosensitive medium 4. Accordingly, a timing for preventing the formation of any image on this portion is provided.

Figure 7:
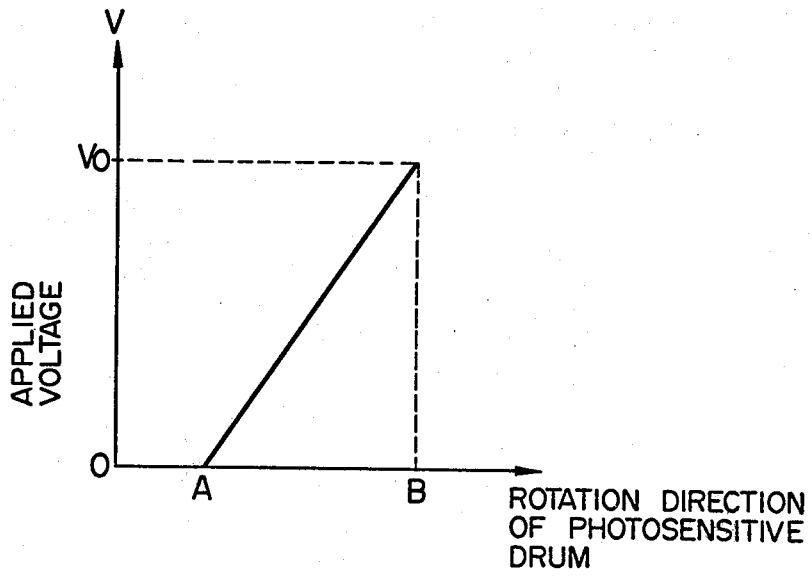
FIG. 7 is a view showing the manner in which power is supplied to a photosensitive drum.
Figure 8:
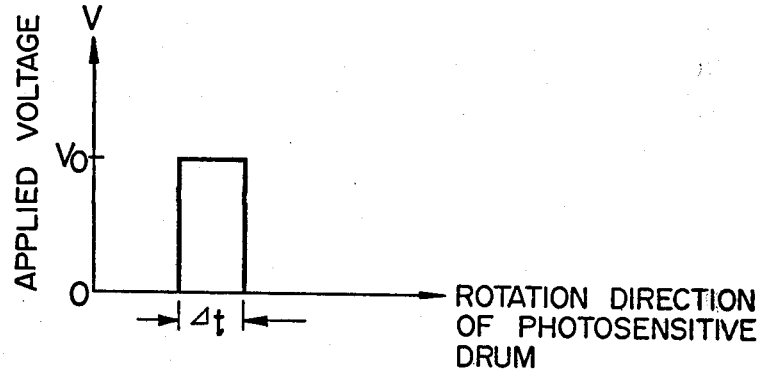
FIG. 8 (PRIOR ART)
FIG. 8 is a view showing the manner in which power is supplied to a photosensitive drum in the prior art.

The power supply means 24 thus supplies a predetermined voltage to the conductive charging belt 22 through the first roller 20. The charging belt 22 in turn applies the predetermined voltage to the photosensitive medium 4 at point B thereof as shown in FIG. 3. Also, a potential gradient toward point A of the medium 4 as is shown can be obtained since the charging belt 22 has a resistivity. Since the photosensitive drum 4 is rotated from the side of point A to the side of point B, the potential developed in it has a straight upward slope from point A to point B as shown in FIG. 7, ultimately reaching the same level as hitherto obtained. In the prior art, the photosensitive medium is charged to a predetermined potential by one step by a voltage applied in the form of a sharply rising pulse, as shown in FIG. 8, by a single charger 11.

By putting an original on the original underlay 2 and depressing a copying button (not shown), the individual component parts are caused to make their operations as mentioned above, and a copy sheet P having a copied image of the original is discharged to the copy tray 15. In the charging device 11, the drive mechanism 23 is operated with the rotation of the photosensitive drum 4 to cause rotation of the first and second rollers 20 and 21 in the direction opposite to the direction of rotation of the drum 4 and at a slightly low peripheral speed with respect thereto. The charging belt 22 is thus moved partly in frictional contact with a part of the peripheral surface of the drum 4, so that uniform contact between the belt 22 and drum 4 can be obtained. Also, in the event a defect of part of the charging belt 22 (such as that due to contamination by toner) arises, it can be sufficiently made up for by the rest of the belt. Further, since the charging belt 22 applies a predetermined voltage, which is supplied from the power supply means 31 through the first roller 20 and consists of DC and AC components superimposed upon each other, to the photosensitive drum 4 at point B and has a resistivity, a potential gradient toward point A is formed. Since the photosensitive drum 4 is rotated from the side of point A to the side of point B, it can be eventually charged to a required potential level at point B without the possibility of causing overcurrent. Furthermore, since the voltage applied consists of DC and AC superimposed upon each other, it is possible to prevent the effect of space charge from being produced in the photosensitive drum 4 and obtain sufficient charging in a short period of time.

The aforementioned range of the characteristic resistance of the charging belt 22, i.e., between about $10^4$ and about $10^{10}$ Ω.cm, is found from various experiments to be an optimum range.

While in the above embodiment the drive mechanism 23 is provided for driving the first and second rollers 20 and 21, it can be dispensed with. This may be done by supporting the charging belt 22 in forced contact with the photosensitive drum 4 so that it is rotated with the rotation of the drum 4. In this case, i.e., without the drive mechanism, the construction can be simplified. In addition, since the belt 22 is in rolling contact with the photosensitive drum 4, the surface thereof is less likely to be damaged.

Further, while in the above embodiment the photosensitive medium 4 is provided in the form of a drum, it may be in a planar form as well.

As has been shown, with the charging device for an electronic copier according to the invention continuous and uniform charging of the photosensitive medium can be reliably obtained without the possibility of causing damage to the photosensitive medium. Also, since a voltage consisting of DC and AC voltage superimposed upon each other is applied, it is possible to make appropriate compensation for the sensitivity of the photosensitive medium, inflow current and voltage and fatigue characteristics and obtain steady and stable charging performance free from the aforementioned deterioration of characteristics even in case when the copier is continuously used. Further, the voltage applied to the photosensitive medium rises smoothly in a predetermined period of time, it aids the protection of the photosensitive medium against damage and improvement of the durability thereof.

Furthermore, with the charging belt moved in contact with the photosensitive medium at a peripheral speed different from that of the medium, even if the belt has a portion which fails to be in contact with the photosensitive medium, this fault can be made up for by the other portion of the belt, and uniform charging can be reliably obtained.

Moreover, with the above embodiment, in which the endless charging belt having a characteristic resistance and to be held at progressively increasing potentials by the voltage from the power supply means is passed round at least two support rollers appropriately spaced apart and extending parallel to the periphery of the photosensitive drum such that it is partly in contact with the periphery of the photosensitive drum, it is possible to provide a large area of contact between the charging belt and photosensitive medium.

Figure 9:
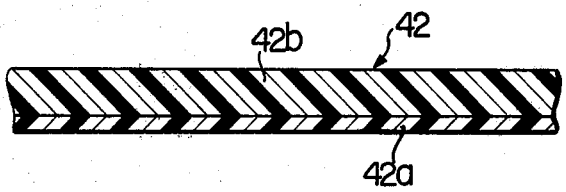
FIG. 9 is a fragmentary sectional view showing a modification of charging belt in the charging device shown in FIG. 2.

FIG. 9 shows a modification of the charging belt in the charging device shown in FIG. 2. This charging belt 42 has a core belt 42a of a poorly extensible and conductive material composed of urethane base and having a thickness of, for instance, about 1.6 mm and a surface member 42b of a conductive material such as conductive polyurethane foam and having a thickness of, for instance, about 3 mm. The surface member 42b is bonded to the surface of the core belt 42a, and it is flexible and has a resistivity of about $10^4$ to about $10^{10}$ Ω.cm.

With this construction, the surface member 42b is in frictional contact with the photosensitive drum 4. In this case, uniform contact between the flexible surface member 42b and photosensitive drum 4 can be obtained as shown in FIG. 10, and a defective portion of the surface member 42b (that may result from contamination by toner or from other causes) can be sufficiently be made up for by the rest of the surface member.

Figure 10:
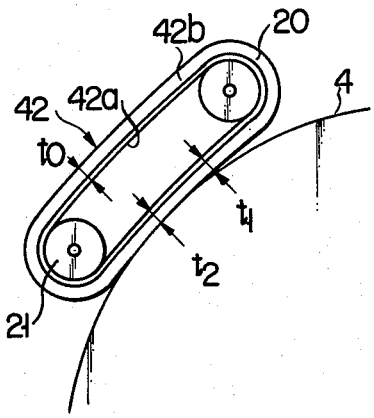
FIG. 10 is a longitudinal sectional view showing the state of contact between the charging belt shown in FIG. 9 and the photosensitive medium.

The thickness of the charging belt in this cases changes such as to meet a relation $t_0 > t_1 > t_2$ with reference to FIG. 10.

With the provision of the poorly extensible core belt 42a as in this case, it is possible to obtain sufficient tension in the belt and dispense with roller drive belt 26 which is required in the construction of FIG. 2, while the flexible and conductive surface member can be held in sufficiently close contact with the photosensitive medium to ensure reliable application of a required voltage.

Figure 11:
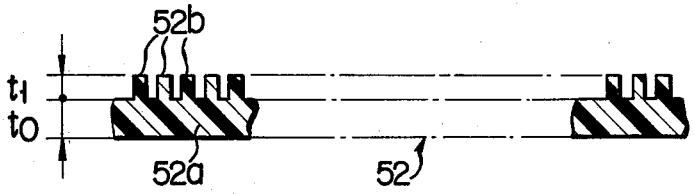
FIG. 11 is a fragmentary sectional view showing another modification of the charging belt in the charging device shown in FIG. 2.

FIG. 11 shows another modification of the charging device shown in FIG. 2. This charging belt 52 is made of, for instance, urethane rubber incorporating carbon and is conductive, having a resistivity of about $10^4$ to about $10^{10}$ Ω.cm. It has a base 52a with a thickness $t_0$ and a number of small integral protuberances 52b projecting from the surface of the base 52a and having a height $t_1$. In a specific example, $t_0$ is 1.5 mm, $t_1$ is 1.0 mm, the diameter of the protuberances is 100 μm, and the spacing between adjacent protuberances is 100 μm.

With this construction, the small protuberances 52b are held in frictional contact with the photosensitive medium. Again in this case, uniform contact can be obtained between the charging belt 52 which is flexible and the drum 4, and even if some of the small protuberances 52b are defective (for instance due to contamination by toner), they can be sufficiently made up for by the other protuberances. Further, in this case the electric field produced in the belt 52 is concentrated in the small protuberances 52b in applying voltage to point B of the photosensitive medium. Thus, the number of small protuberances 52b provided in the charging belt 52 on the side thereof in contact with the photosensitive medium 4 has the effects of improving the flexibility of the charging belt 52 and permitting concentration of electric field in them, so that it is possible to improve the effect of charging the photosensitive medium.

What we claim is:

1. An electronic copier comprising:

(a) a photosensitive medium;

(b) charging belt means, provided to be in contact with said photosensitive medium and having a characteristic resistance ranging from about $10^4$ to about $10^{10}$ Ω.cm, for charging said photosensitive medium;

(c) power supply means for applying a voltage smoothly increasing over a predetermined period of time to said charging belt means;

(d) exposure device means for forming an electrostatic latent image on said photosensitive medium after it has been charged;

(e) developing device means for developing the electrostatic latent image formed on said photosensitive medium to obtain a visible image;

(f) transfer device means for transferring the visible image formed on said photosensitive medium onto a recording sheet; and (g) fixing device means for fixing the visible image transferred onto said recording sheet.

2. An electronic copier according to claim 1, wherein the voltage applied by said power supply means to said charging belt is a voltage comprising a DC voltage and an AC voltage superimposed upon each other.

3. An electronic copier according to claim 2, wherein the proportions of said DC and AC voltages superimposed upon each other are such that the zero-to-peak value of said AC voltage is no greater than 20% of said DC voltage.

4. An electronic copier comprising:

(a) a photosensitive medium;

(b) endless charging belt means, provided in contact with said photosensitive medium and having a characteristic resistance ranging from about $10^4$ to about $10^{10}$ Ω.cm, for charging said photosensitive medium;

(c) drive mechanism means for driving said charging belt at a peripheral speed different from that of said photosensitive medium;

(d) power supply means for applying a voltage to said charging belt means such as to produce a potential gradient therein;

(e) exposure device means for forming an electrostatic latent image on said photosensitive medium;

(f) developing device means for developing the electrostatic latent image formed on said photosensitive medium to obtain a visible image;

(g) transfer device means for transferring the visible image formed on said photosensitive medium onto a recording sheet; and (h) fixing device means for fixing the visible image transferred onto said recording sheet.

5. An electronic copier comprising:

(a) a photosensitive medium;

(b) at least two support rollers rotatably supported parallel to the periphery of said photosensitive medium and spaced apart from one another;

(c) drive mechanism means for rotating said support rollers;

(d) endless charging belt means passed around said support rollers such that it is partly in contact with the periphery of said photosensitive medium, said charging belt being conductive and having a characteristic resistance ranging from about $10^4$ to about $10^{10}$ Ω.cm;

(e) power supply means for supplying a voltage smoothly increasing over a predetermined period of time to said charging belt;

(f) exposure device means for forming an electrostatic latent image on said photosensitive medium;

(g) developing device means for developing the electrostatic latent image formed on said photosensitive medium to obtain a visible image;

(h) transfer device means for transferring the visible image formed on said photosensitive medium; and (i) fixing device means for fixing the visible image transferred onto said recording sheet.

6. An electronic copier according to claim 5, wherein said drive mechanism means comprises means for driving said support rollers such that said charging belt is moved at a peripheral speed different from that of said photosensitive medium.

7. An electronic copier according to claim 1, 4 or 5, wherein said charging belt means is made of a flexible conductive rubber material so that it may be in close contact with said photosensitive medium.

8. An electronic copier according to claim 1, 4 or 5, wherein said charging belt means has a number of small protuberances provided on its side in contact with said photosensitive medium.

9. An electronic copier according to claim 1, 4 or 5, wherein said charging belt means has a poorly extensible core belt and a flexible surface member provided on said core belt, said surface member being deformable to provide the same radius of curvature as that of said photosensitive medium.

* * * * *